US008336162B2

(12) United States Patent
Dever

(10) Patent No.: US 8,336,162 B2
(45) Date of Patent: Dec. 25, 2012

(54) AGITATOR BELT DRIVE INTERRUPT SYSTEM

(75) Inventor: Kerry L. Dever, Lexington, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 557 days.

(21) Appl. No.: 12/574,387

(22) Filed: Oct. 6, 2009

(65) Prior Publication Data

US 2011/0078874 A1 Apr. 7, 2011

(51) Int. Cl.
*A47L 5/10* (2006.01)
*A47L 5/26* (2006.01)

(52) U.S. Cl. ..... 15/390

(58) Field of Classification Search ..... 15/390
See application file for complete search history.

(56) References Cited

U.S. PATENT DOCUMENTS

| | | | | | |
|---|---|---|---|---|---|
| 1,438,890 | A | * | 12/1922 | Bobst | 15/390 |
| 2,601,698 | A | * | 7/1952 | Humphrey | 15/390 |
| 4,748,714 | A | | 6/1988 | Tschudy | |
| 5,031,267 | A | * | 7/1991 | Bewley | 15/377 |
| 5,537,712 | A | * | 7/1996 | Weber et al. | 15/391 |
| 5,839,160 | A | | 11/1998 | Wang et al. | |
| 6,098,243 | A | | 8/2000 | Kim | |
| 6,158,084 | A | | 12/2000 | Weber et al. | |
| 7,107,647 | B2 | | 9/2006 | Park | |
| 7,120,964 | B2 | * | 10/2006 | Roney | 15/391 |
| 7,426,770 | B2 | * | 9/2008 | Moon | 15/390 |
| 2007/0056137 | A1 | | 3/2007 | Miner et al. | |
| 2007/0234505 | A1 | | 10/2007 | Gordon et al. | |
| 2007/0283522 | A1 | | 12/2007 | Choi et al. | |
| 2008/0134463 | A1 | | 6/2008 | Choi et al. | |
| 2008/0216283 | A1 | * | 9/2008 | Miner et al. | 15/390 |

* cited by examiner

*Primary Examiner* — Bryan R Muller
(74) *Attorney, Agent, or Firm* — King & Schickli, PLLC

(57) ABSTRACT

A floor care appliance has a body including a control assembly and a nozzle assembly, a rotary agitator carried on the nozzle assembly and a dirt collection vessel carried on the body. In addition a suction generator is carried on the body. The suction generator includes a fan and a drive motor. A belt operably connects the drive motor to the rotary agitator. An agitator drive interrupt mechanism includes an idler pulley support and first and second idler pulleys carried on the idler pulley support. The idler pulley support is displaceable between a first position wherein the idler pulleys tension the belt to provide drive to the rotary agitator and a second position wherein the idler pulleys de-tension the belt and interrupt drive to the rotary agitator.

6 Claims, 10 Drawing Sheets

AGITATOR BELT DRIVE INTERRUPT SYSTEM

TECHNICAL FIELD AND INDUSTRIAL APPLICABILITY OF THE INVENTION

The present invention relates generally to the floor care equipment field and, more particularly, to a floor care appliance or vacuum cleaner equipped with a rotary agitator, a suction generator including a fan and drive motor, a drive belt for operatively connecting the drive motor of the suction generator to the rotary agitator and a new and improved agitator drive interrupt mechanism for more efficient bare floor cleaning operations.

BACKGROUND OF THE INVENTION

A vacuum cleaner is an electro-mechanical appliance utilized to effect the dry removal of dust, dirt and other small debris from carpets, rugs, fabrics or other surfaces in domestic, commercial and industrial environments. In order to achieve the desired dirt and dust removal, most vacuum cleaners incorporate a rotary agitator. The rotary agitator is provided to beat dirt and debris from the nap of the carpet or rug while a pressure drop or vacuum is used to force air entrained with this dirt and debris into the nozzle of the vacuum cleaner. The particulate laden air is then drawn into a dirt collection vessel. Next, the air is drawn through a filter before being directed through the motor of the suction generator to provide cooling. Finally, the air is filtered to remove any fine particles of carbon from the brushes of that motor or other dirt that might remain in the air-stream before being exhausted back into the environment.

While the rotary agitator is particularly beneficial in cleaning dirt and debris from the nap of a carpet or rug, it has long been known that the turbulence produced by a rapidly rotating agitator often interferes with the efficient cleaning of dirt and debris from a bare floor such as a hardwood or linoleum covered floor. Thus, for bare floor cleaning applications it is desirable to interrupt power to the rotary agitator. Where an upright vacuum cleaner incorporates a separate drive motor for the agitator, this is easily accomplished by simply de-energizing that dedicated drive motor. However, in order to lower production costs, minimize weight and reduce the size of an upright vacuum cleaner, many upright vacuum cleaners drive the rotary agitator through a power takeoff connected to the motor of the suction generator.

The interruption of the drive between the motor of the suction generator and the rotary agitator has taken many forms. Often, power is transmitted from the drive shaft of the suction generator motor to the agitator by means of a belt. In one approach a belt shifter is provided to shift the belt between the agitator drive pulley and an idler pulley to interrupt power transmission to the agitator. An example of just such an approach is disclosed in U.S. Pat. No. 5,768,746 to Kamatani et al. In yet another approach, an idler pulley is utilized to tension the drive belt to provide drive to the agitator and de-tension the drive belt to interrupt drive to the agitator. Such an approach is disclosed in, for example, U.S. Pat. Nos. 5,537,712 to Weber et al. and 6,915,544 to Roney et al.

The present invention relates to a floor care appliance or vacuum cleaner incorporating a new and improved agitator drive interrupt mechanism to more efficiently and effectively interrupt drive between the drive motor of the suction generator and the rotary agitator as desired by the operator.

SUMMARY OF THE INVENTION

In accordance with the purposes of the present invention as described herein, a floor care appliance comprises a body including a control assembly and a nozzle assembly, a rotary agitator carried on the nozzle assembly, a dirt collection vessel carried on the body and a suction generator carried on the body. The suction generator includes a fan and a drive motor. A belt operably connects the drive motor of the suction generator to the rotary agitator. In addition the floor care appliance includes an agitator drive interrupt mechanism. That interrupt mechanism includes an idler pulley support and first and second idler pulleys carried on the idler pulley support. The idler pulley support is selectively displaceable between a first position wherein the first and second idler pulleys tension the belt to provide drive to the rotary agitator and a second position wherein the first and second idler pulleys de-tension the belt and interrupt drive to the rotary agitator.

Further describing the invention, the appliance includes a drive shaft connected to the drive motor and an agitator pulley connected to the rotary agitator. The belt extends in a first path and a second path between the drive shaft and the agitator pulley. The first idler pulley contacts the belt along the first path while the second idler pulley contacts the belt along the second path. The drive belt interrupt system further includes a spring for biasing the idler pulley support into the first or belt tensioning position. In one particularly useful embodiment the spring is a torsion spring received concentrically around the drive shaft.

The idler pulley support further includes a belt slack flange. The belt slack flange functions to hold belt slack adjacent the drive shaft when the idler pulley support is in the second position. As a consequence the belt is disengaged from the drive shaft of the drive motor thereby insuring interruption of drive to the rotary agitator. The first and second idler pulleys freely rotate relative to the idler pulley support. Specifically, each idler pulley comprises a freely rotating idler sleeve bearing received on a bearing pin connected to the idler pulley support.

In accordance with one possible embodiment of the present invention, the idler pulley support is articulated and includes a first section carried over a drive shaft and a second section pivotally attached to the first section by a pivot pin. In this embodiment a spring is provided for biasing the second section relative to the first section. Where the spring is a torsion spring it is received concentrically around the pivot pin.

The first section of the articulated idler pulley support includes a belt slack flange that holds belt slack adjacent to the drive shaft when the idler pulley support is in the second or drive interrupt position. The second section of the articulated idler pulley support includes a first lug and a second lug. The first idler pulley is carried on the first lug while the second idler pulley is carried on the second lug. As noted above, each idler pulley comprises a freely rotating idler sleeve bearing received on a bearing pin connected to the pulley support.

In accordance with additional aspects of the present invention the dirt collection vessel may take substantially any form including a filter bag and a dirt cup. Further, the control assembly may be pivotally connected to the nozzle assembly in the manner of a standard upright vacuum cleaner.

In accordance with yet another aspect of the present invention a floor care appliance comprises a body including a control assembly and a nozzle assembly, a rotary agitator carried on the nozzle assembly and a dirt collection vessel carried on the body. A suction generator is also carried on the body. The suction generator includes a fan and a drive motor having a drive shaft. A belt operably connects the drive motor to the rotary agitator. Further, an agitator drive interrupt mechanism includes an articulated idler pulley support carried on the body and at least one idler pulley carried on the articulated idler pulley support. The articulated idler pulley support is displaceable between a first position wherein the at least one idler pulley tensions the belt to provide drive to the rotary agitator and a second position wherein the at least one idler pulley de-tensions the belt and interrupts drive to the rotary agitator.

As noted above, the idler pulley support includes a first section carried over the drive shaft and a second section pivotally attached to the first section by a pivot pin. A spring is provided for biasing the second section relative to the first section. In addition, the first section includes a belt slack flange. The belt slack flange holds belt slack adjacent to the drive shaft when the idler pulley support is in the second position in order to insure interruption of drive to the rotary agitator.

In the following description there is shown and described several different embodiments of the invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated herein and forming a part of the specification, illustrate several aspects of the present invention and together with the description serve to explain certain principles of the invention. In the drawings.

Reference will now be made in detail to the present preferred embodiment of the invention, examples of which are illustrated in the accompanying drawings.

DETAILED DESCRIPTION OF THE PREFERRED EMBODIMENTS OF THE INVENTION

Figure 1:
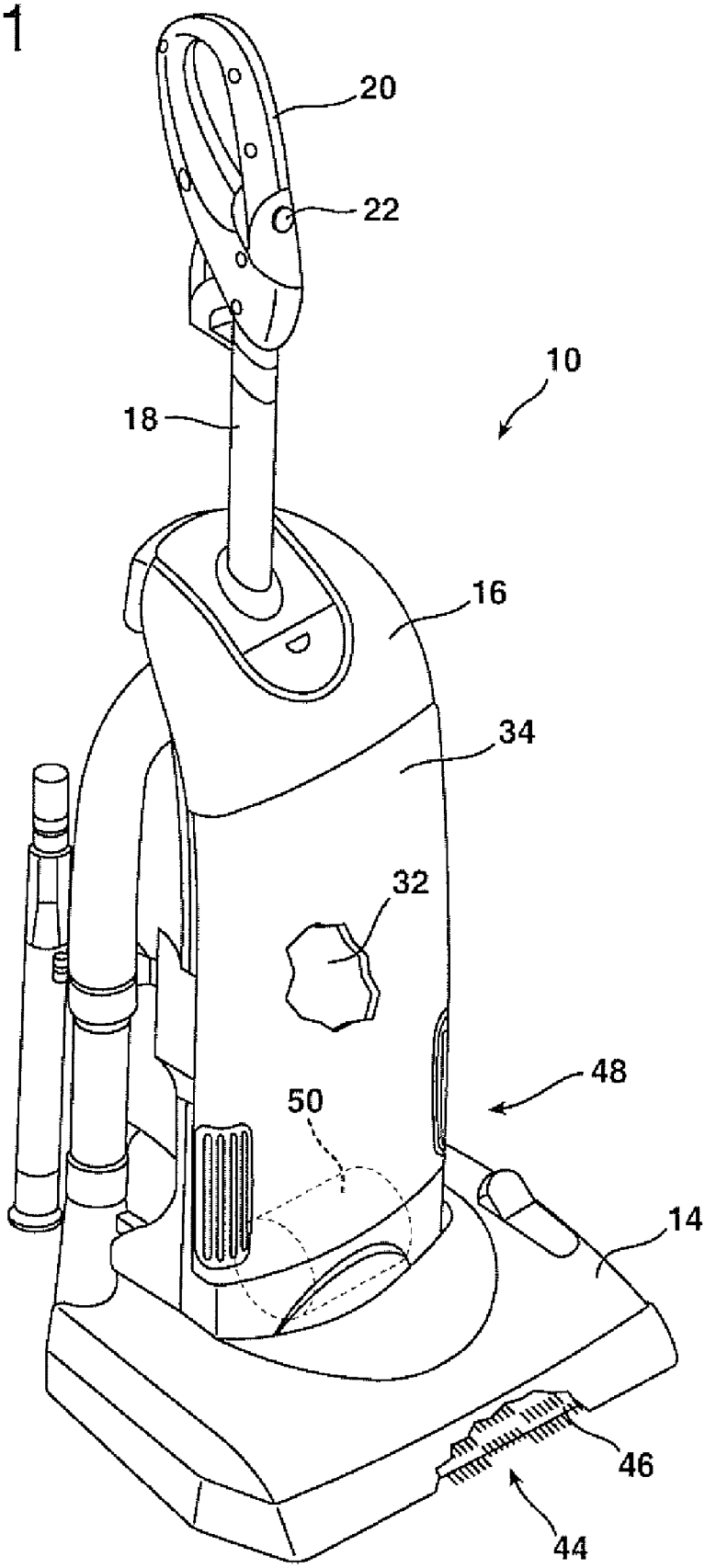
FIG. 1 is a perspective view of a floor care appliance and, more particularly, a vacuum cleaner constructed in accordance with the teachings of the present invention.

Reference is now made to FIG. 1 showing the upright vacuum cleaner 10 of the present invention. The upright vacuum cleaner 10 includes a body comprising a nozzle assembly 14 and a control or handle assembly 16. The control assembly 16 further includes a control handle 18 and a handgrip 20. A control switch 22 is provided for turning the vacuum cleaner 10 on and off. Of course, electrical power is supplied to the vacuum cleaner 10 from a standard electrical wall outlet through an electrical cord (not shown). Alternatively, the vacuum cleaner 10 could be battery powered.

A pair of rear wheels (not shown) are provided on the lower portion of the control assembly 16 and a pair of front wheels (also not shown) are provided on the nozzle assembly 14. Together, these wheels support the vacuum cleaner 10 for movement across the floor. To allow for convenient storage of the vacuum cleaner 10, a foot latch (not shown) functions to lock the control assembly in an upright position as shown in FIG. 1. When the foot latch is released, the control assembly 16 may be pivoted relative to the nozzle assembly 14 into an oblique position as the vacuum cleaner 10 is manipulated back and forth to clean the floor.

In the presently illustrated embodiment, the control assembly 16 includes a cavity adapted to receive and hold the dirt collection vessel 32. More specifically, the cavity is a filter bag compartment enclosed by a cover 34 and the dirt collection vessel 32 is a filter or vacuum cleaner bag. In an alternative embodiment, the dirt collection vessel 32 may take the form of a dirt cup. That dirt cup may include a cylindrical sidewall, a tangentially directed inlet and an axially directed outlet. A primary filter may be provided in the dirt cup over the axially directed outlet. The primary filter may be cylindrical in shape and concentrically received within the cylindrical sidewall of the dirt cup. Such a structural arrangement induces cyclonic airflow in the dirt cup and provides for enhanced cleaning efficiency.

The nozzle assembly 14 includes a suction inlet 44. A rotary agitator 46 is carried on the nozzle assembly 14 so as to extend across the suction inlet 44. A suction generator 48, including a fan and a cooperating drive motor 50, is carried on the control assembly 16. The suction generator 48 functions to generate a vacuum air stream for drawing dirt and debris from the surface to be cleaned. The rotary agitator assembly 46 is connected by power take off to the motor 50 of the suction generator 48. While the suction generator 48 is illustrated as being carried on the control assembly 16, it should be appreciated that, alternatively, it could be carried on the nozzle assembly 14 if desired.

During normal vacuum cleaner operation, the rotary agitator 46 is driven by the motor 50 of the suction generator 48 and functions to beat dirt and debris from the nap of an underlying carpet. The suction generator 48 functions to draw a vacuum air stream into the suction inlet 44. Dirt and debris from the carpet is entrained in the air stream, which is then drawn by the suction generator 48 into the dirt collection vessel 32. Dirt is filtered from the air stream and trapped in the dirt collection vessel 32 as the air stream is drawn through the wall of the bag or through the filter in the dirt cup toward the suction generator 48. The air stream then passes over/through the motor 50 to provide cooling before being passed through a final filter, such as a HEPA filter (not shown) and then being exhausted through an exhaust port into the environment.

Figure 2A:
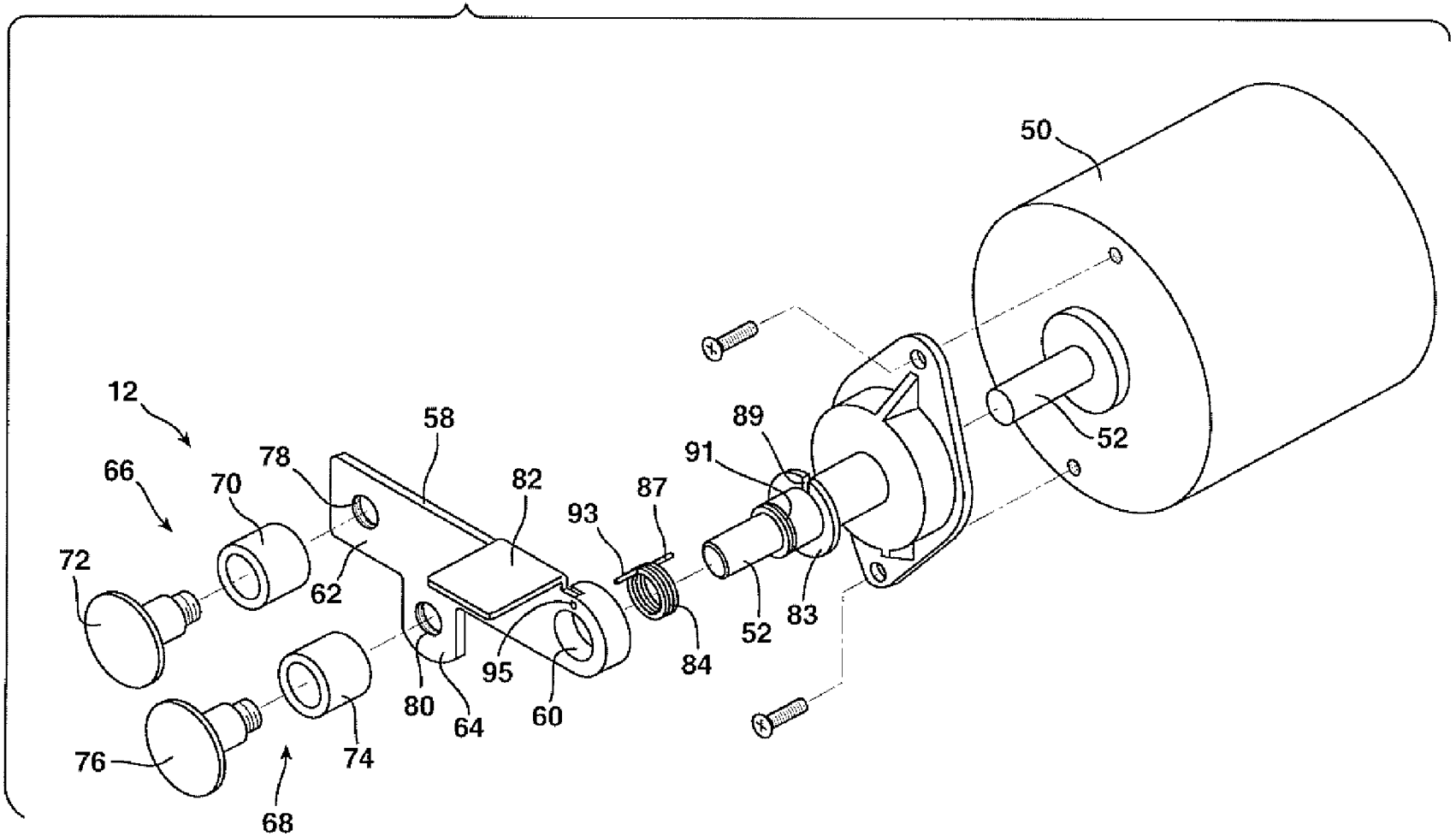
FIG. 2*a* is an exploded perspective view of a first embodiment of the agitator drive interrupt mechanism.
Figure 2B:
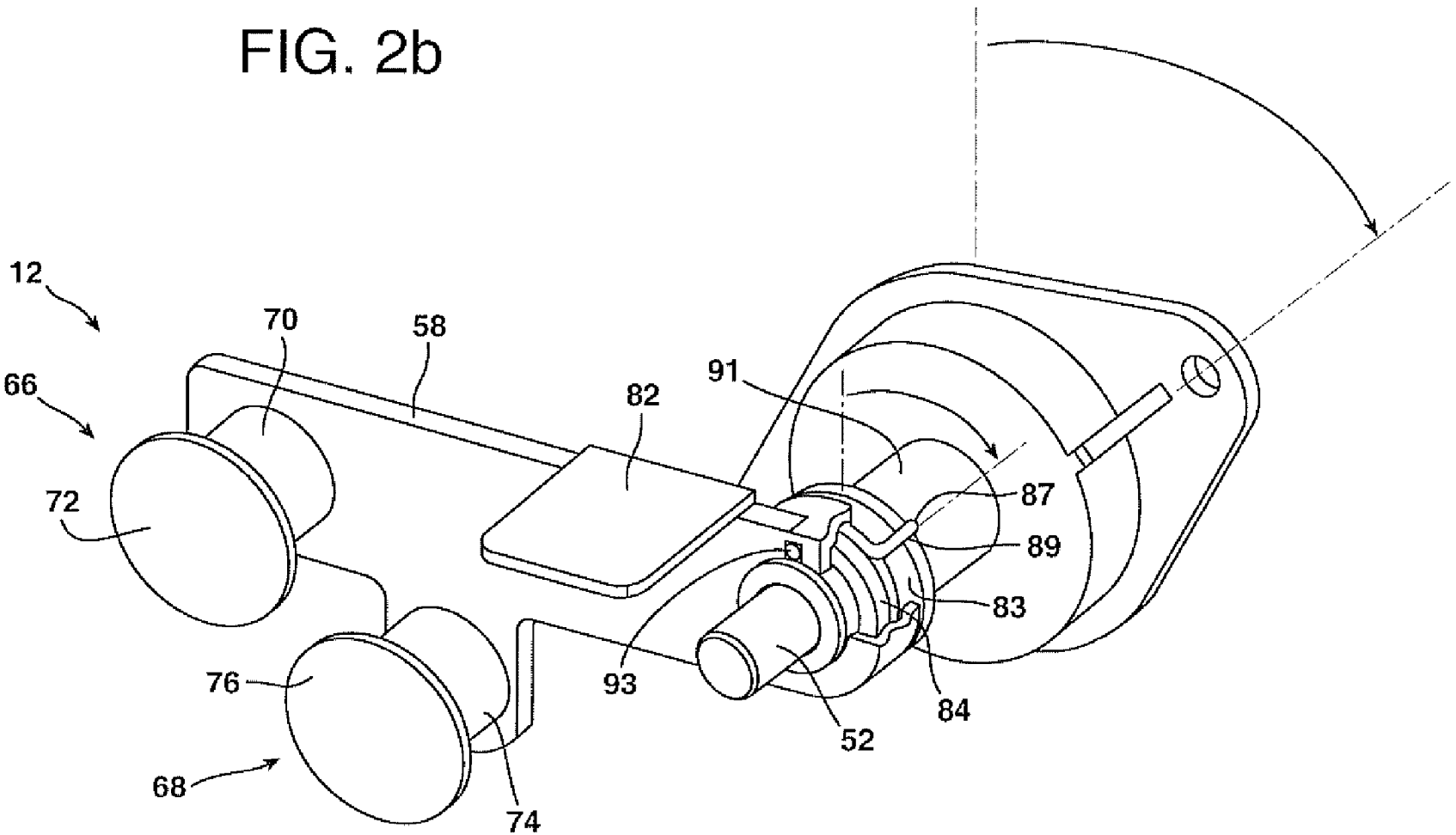
FIG. 2*b* is a perspective view of the assembled embodiment of the agitator drive interrupt system illustrated in FIG. 2*a* illustrated in the first or drive position.
Figure 2C:
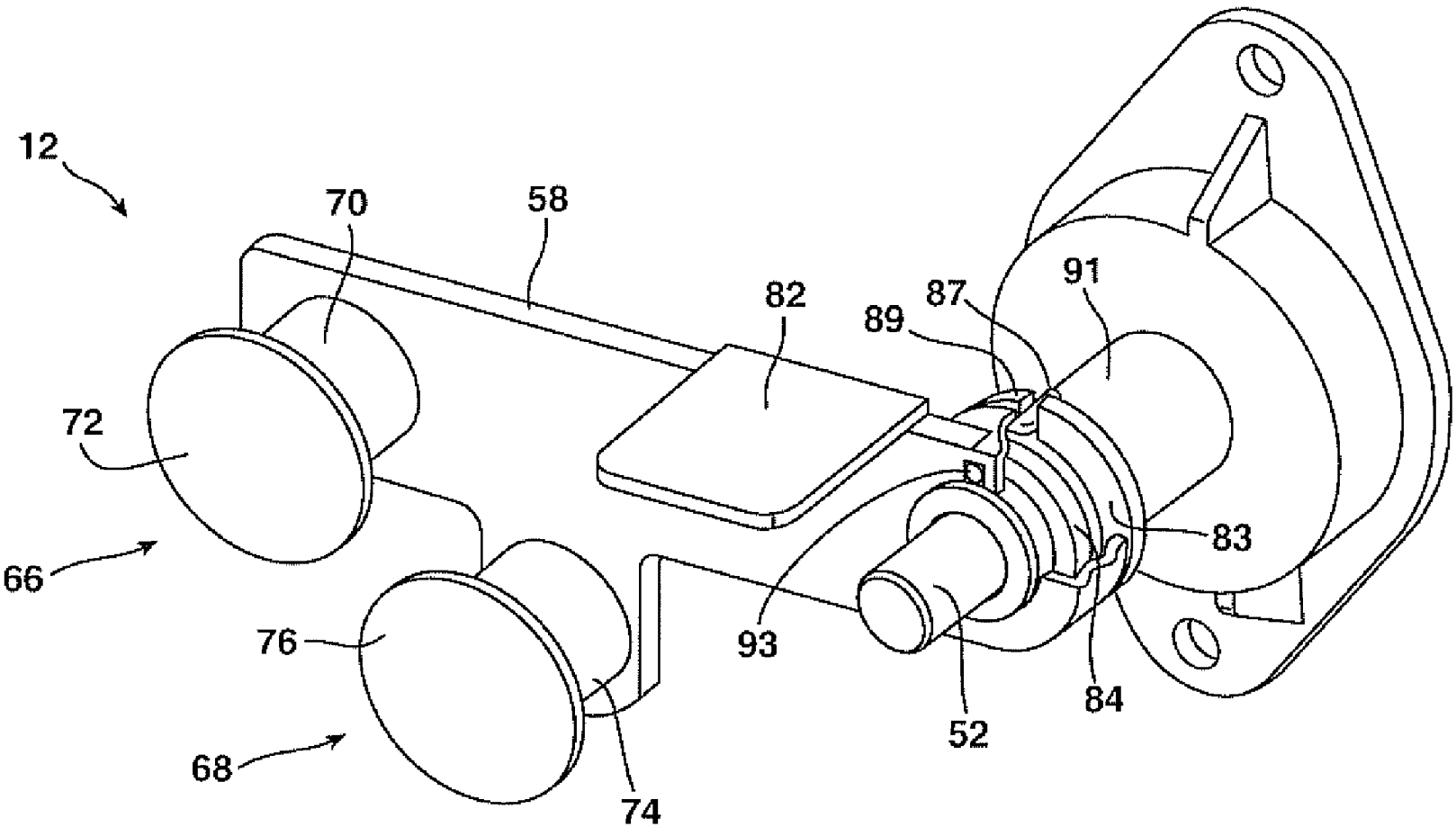
FIG. 2*c* is a view similar to FIG. 2*b* but illustrating the assembled embodiment in the second or detensioning position.
Figure 3A:
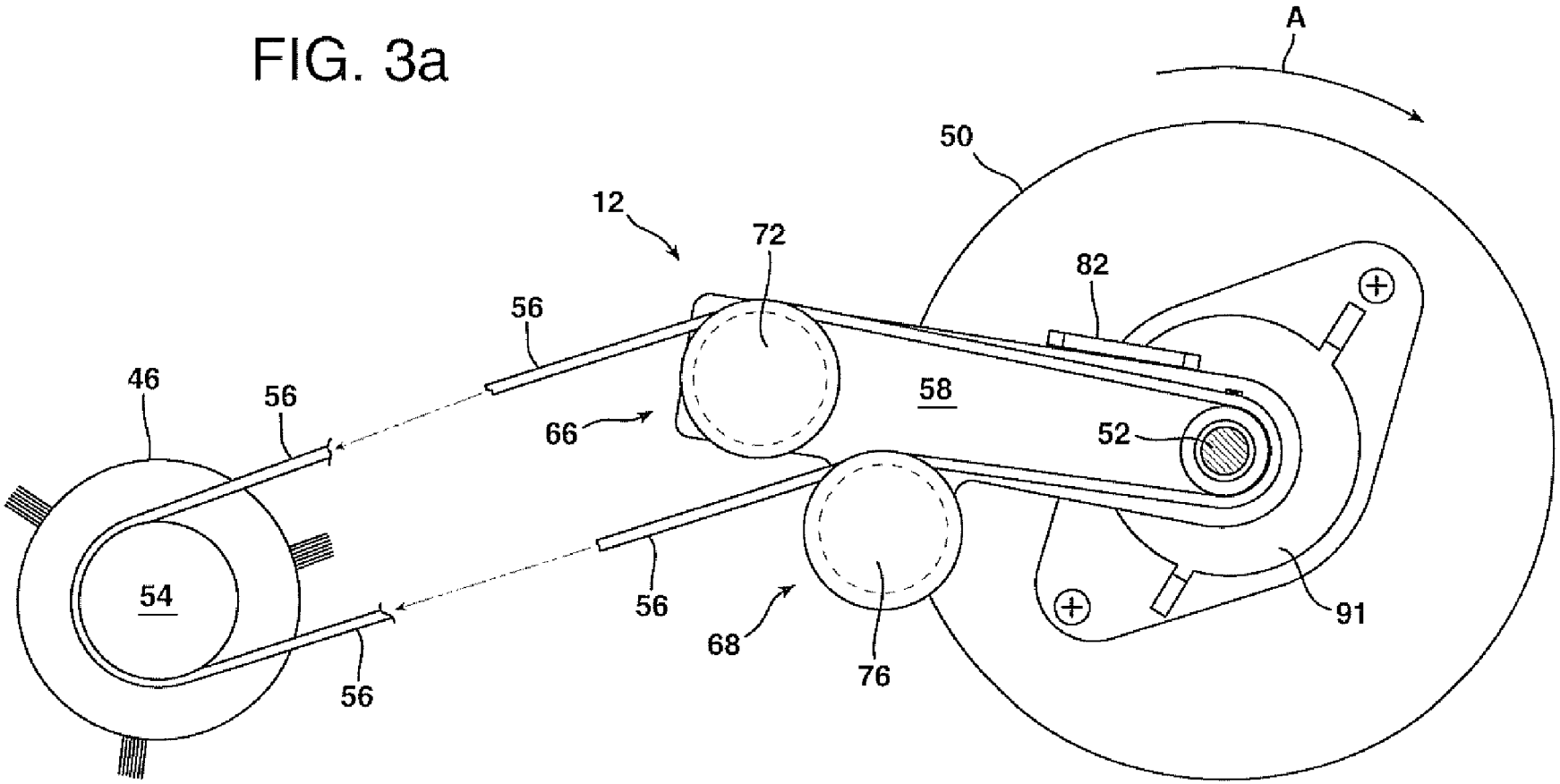
FIGS. 3*a* and 3*b* are detailed side elevational views further illustrating the agitator drive interrupt mechanism of FIGS. 2*a*-2*e* in a first position, tensioning the drive belt so as to provide drive to the rotary agitator and a second position de-tensioning the drive belt so as to interrupt drive to the rotary agitator.
Figure 3B:
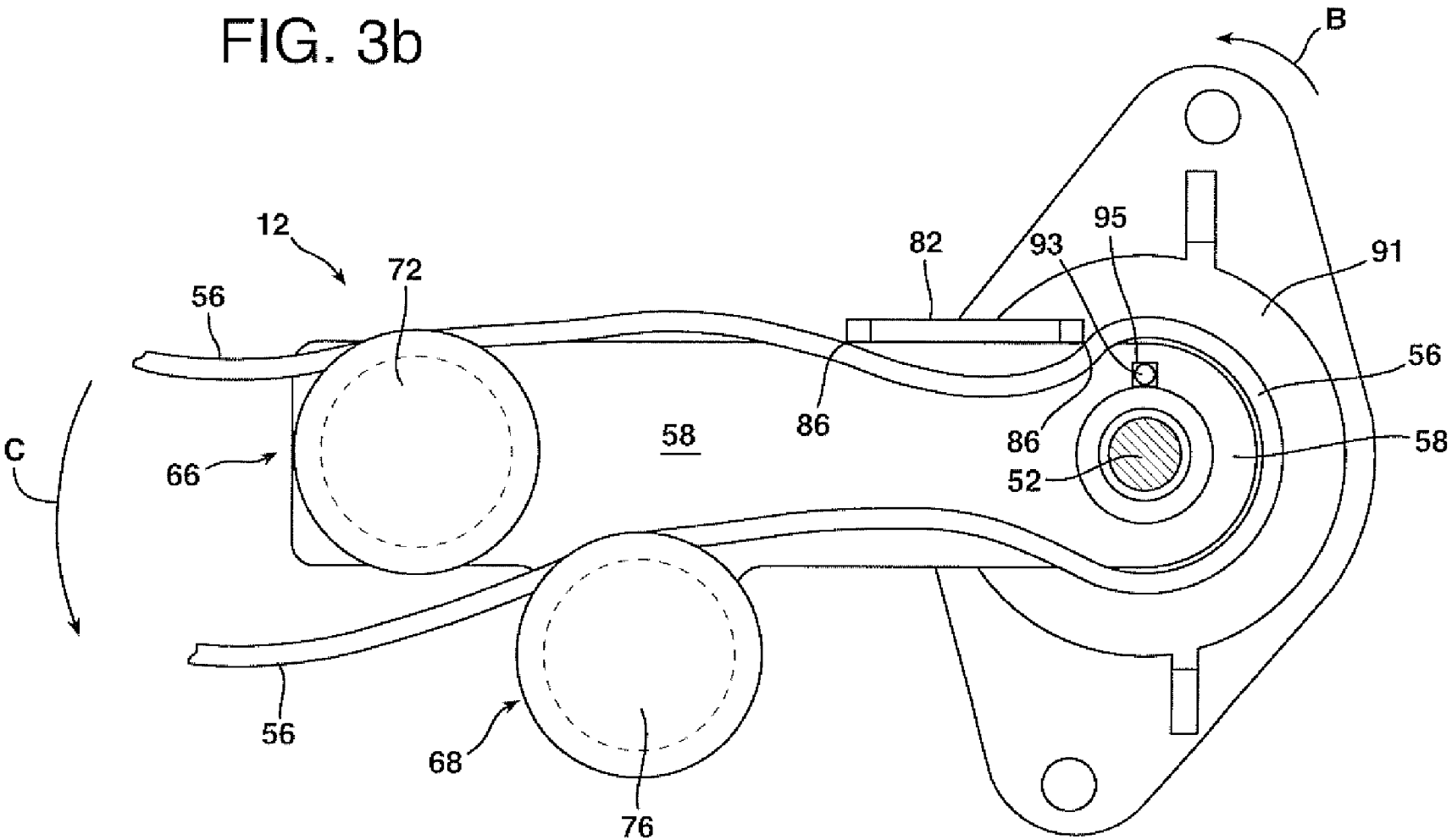

As should be appreciated from reviewing FIG. 3*b*, the drive motor 50 drives the rotary agitator through a power take off. The motor 50 includes a drive shaft 52. The rotary agitator 46 includes an agitator pulley 54. A belt 56 operatively connects the drive motor 50 to the rotary agitator 46. More specifically, the belt 56 engages the drive shaft 52 at one end and the agitator pulley 54 at the other. The belt 56 is an oversized, non-stretch belt made of, for example, fiber reinforced rubber material. The agitator drive interrupt mechanism 12 of the present invention is selectively displaceable between a first position to provide drive from the drive shaft 52 to the agitator 46 and a second position wherein drive to the agitator 46 is interrupted. A first embodiment of the agitator drive interrupt mechanism 12 is illustrated in FIGS. 2*a*, 2*b*, 2*c*, 3*a* and 3*b* while a second embodiment is illustrated in FIGS. 4*a*, 4*b* and 5*a*, 5*b*.

As best illustrated in FIGS. 2*a* and 2*b*, the first embodiment of the agitator drive interrupt mechanism 12 includes an idler pulley support 58. Idler pulley support 58 includes a mounting aperture 60 that is freely received over the drive shaft 52 that extends from the motor through the motor housing trunion 91. In addition the idler pulley support 58 includes a first lug 62 and a second lug 64. A first idler pulley 66 is carried on the first lug 62 while a second idler pulley 68 is carried on the second lug 64. The first idler pulley 66 comprises a first bearing sleeve 70 and a first bearing pin 72 for securing the first bearing sleeve to a first hole 78 in the first lug 62 of the support 58. The second idler pulley 68 includes a second bearing sleeve 74 and a second bearing pin 76 for securing the second bearing sleeve 74 to the second lug 64 in the second hole 80. As further illustrated, the idler pulley support 58 includes a belt slack flange 82 mounted along and projecting from an upper edge of the support at a 90° angle to the longitudinal axis of the support. The function of the belt slack flange 82 will be described in detail below. FIGS. 2*b* and 2*c* show the assembled first embodiment of the agitator drive interrupt mechanism 12.

Reference is now made to FIGS. 2*b* and 3*a* illustrating the first embodiment of the agitator drive interrupt mechanism 12 in the first position wherein the first and second idler pulleys 66, 68 tension the belt 56 to provide drive to the rotary agitator 46. As is known in the art, the motor housing 91 forms one of the two opposed trunnions that provide the pivotal connection between the control assembly 16 and the nozzle assembly 14. The motor housing 91 includes a lumen. The drive shaft 52 of the motor 50 extends through this lumen and projects from the motor housing 91. The motor drive shaft 52 rotates freely relative to the motor housing 91.

As illustrated in FIGS. 2*a*-2*c*, a torsion spring 84 is mounted on the motor housing 91 concentrically over the drive shaft 52. A first end 87 of the spring 84 engages in a notch 89 provided in a flange 83 of the motor housing 91 while a second end 93 of the spring engages in an aperture 95 provided in the idler pulley support 58. When the control assembly 16 and motor housing 91 are pivoted downwardly relative to the nozzle assembly 14 from the storage position illustrated in FIG. 1 to an operative, cleaning position (note action arrow A in FIG. 3*b*), the torsion spring 84 is loaded (see FIG. 2*b*). As a result, the idler pulley support 58 is biased about the motor housing 91 in the direction of action arrow A. As this occurs, the first idler pulley 66 intercepts or extends into a first path of the belt 56 between the drive shaft 52 and the agitator pulley 54 while the second idler pulley 68 intercepts or extends into a second path of the belt 56 between the drive shaft and the agitator pulley. Thus, the first idler pulley 66 engages or contacts the belt 56 along the first path and the second idler pulley 68 engages or contacts the belt 56 along the second path while the torsion spring 84 biases the pulleys to insure that the proper tension is placed on the belt. Together, the two points of contact allow the agitator drive interrupt mechanism 12 to quickly take up the slack and properly tension the belt 56 so that the belt is brought into engagement with the drive shaft 52 and agitator pulley 54. As a consequence, the drive shaft 52 drives the agitator pulley 54 and, therefore, the rotary agitator 46 in a smooth and efficient manner.

In contrast, when the control assembly 16 is pivoted into the storage position (note action arrow B in FIG. 3*a*), loading is removed from the torsion spring 84. As a result opposing spring force causes the idler pulley support 58 to pivot downwardly (note action arrow C) into a substantially horizontal position as illustrated in FIG. 3*a*. In this position the idler pulleys 66, 68 are brought out of engagement with and, therefore, de-tension the belt 56. As should be appreciated, the belt slack flange 82 engages the top of the belt 56 during this movement. The two points of contact 86 between the belt slack flange 82 and the belt 56 function to hold or localize the belt slack around the drive shaft 52 thereby rapidly and efficiently de-coupling the belt 56 from the drive shaft and thereby interrupting drive to the rotary agitator 46. It should be appreciated that the dual idler pulleys 66, 68 simultaneously release tension so as to more rapidly interrupt drive and reduce belt wear than possible with an interrupt system incorporating a single idler pulley.

Figure 4A:
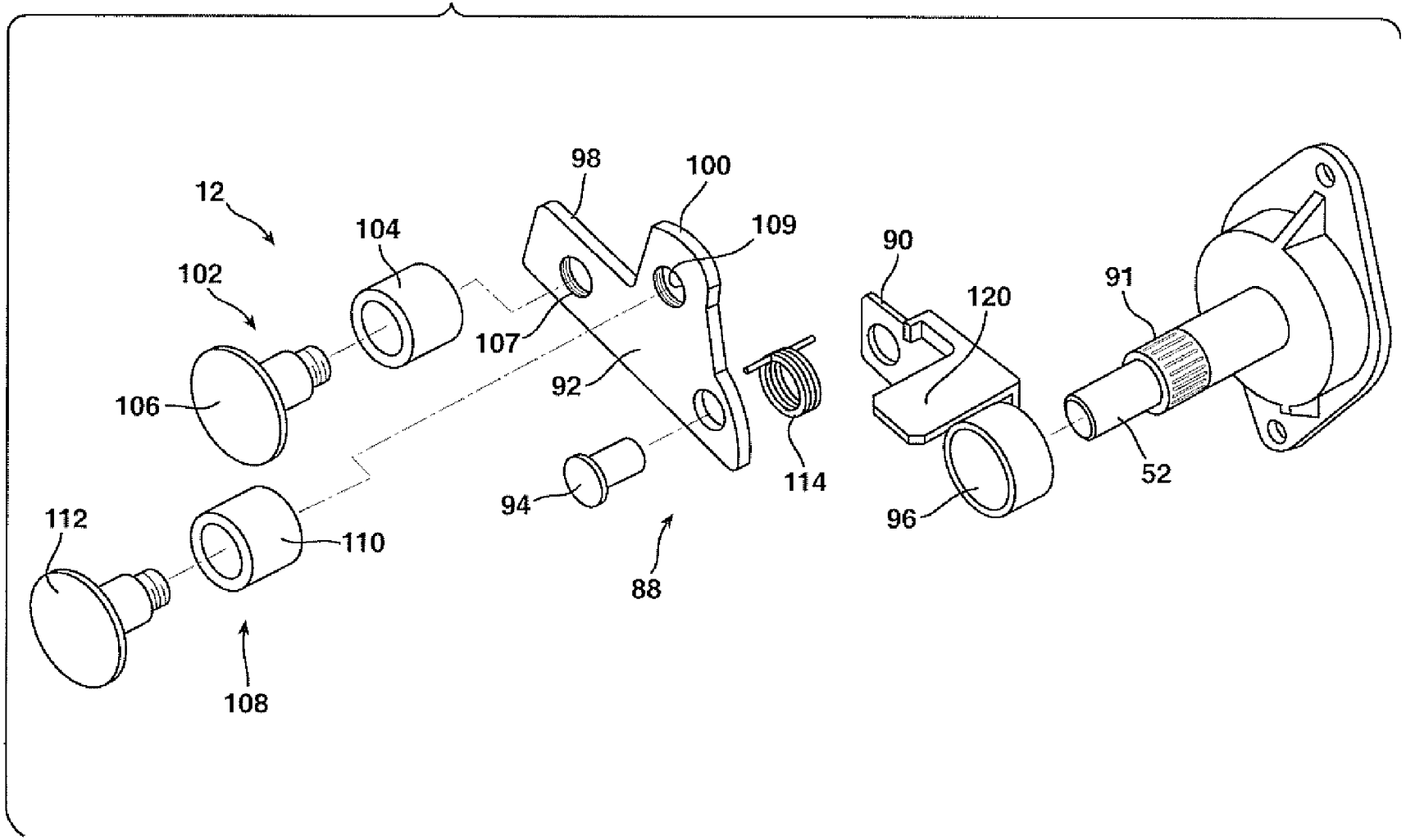
FIG. 4*a* is an exploded perspective view of a second embodiment of the agitator drive interrupt mechanism of the present invention.
Figure 4B:
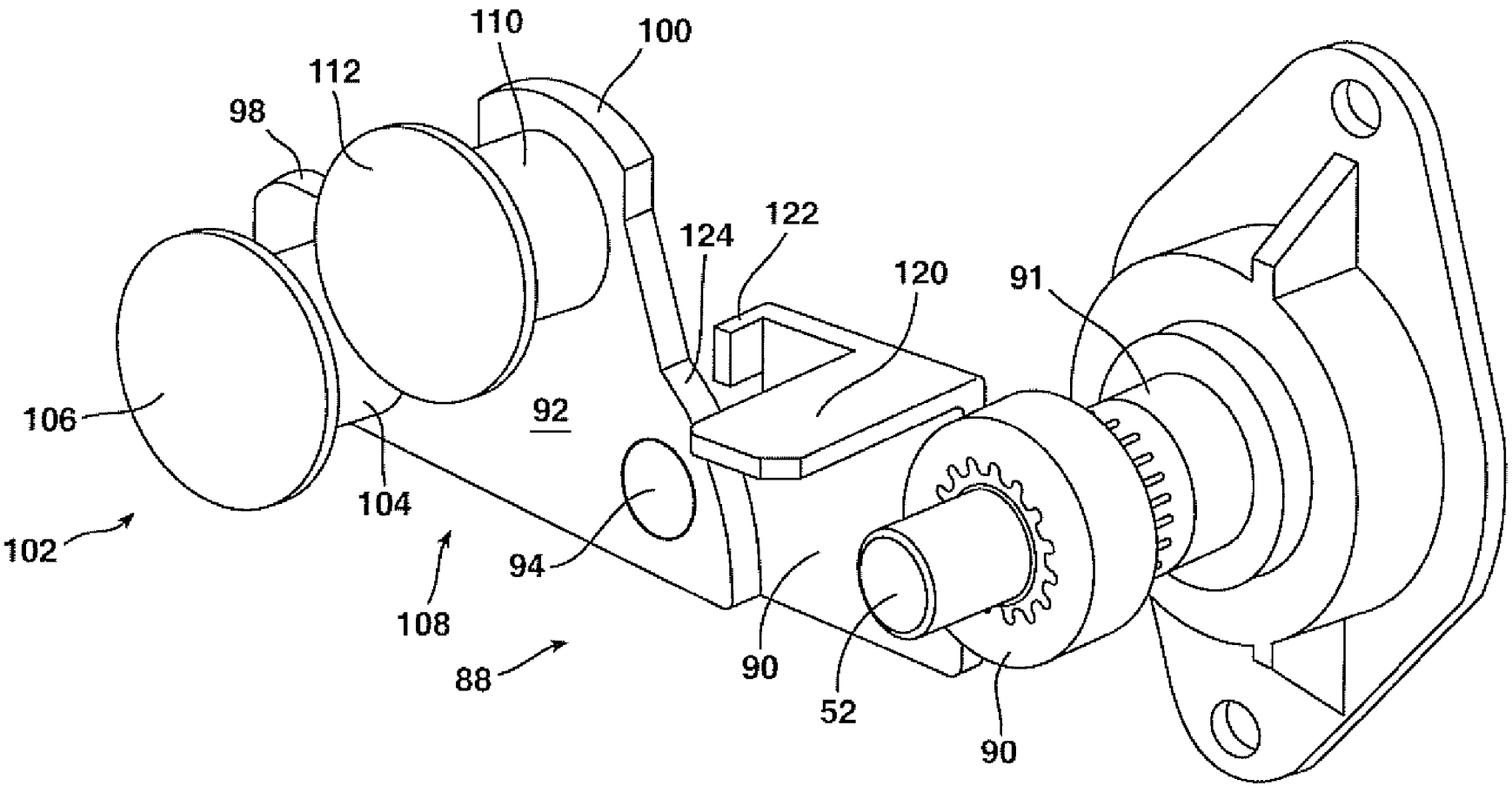
FIG. 4*b* is a perspective view of the embodiment of the agitator drive interrupt mechanism illustrated in FIG. 4*a*.

An alternative embodiment of the agitator drive interrupt mechanism 12 of the present invention is illustrated in FIGS. 4*a* and 4*b*. In this embodiment the idler pulley support 88 is articulated and includes a first section 90 and a second section 92 pivotally connected together by means of a pivot pin 94. The first section 90 includes a mounting aperture 96 that is freely received on and keyed to the motor housing 91 over the drive shaft 52 of the drive motor 50. The second section 92 includes a first lug 98 and a second lug 100. A first idler pulley 102, comprising a first idler sleeve bearing 104 and a first bearing pin 106, is mounted to the first lug 98 in a hole 107. A second idler pulley 108, including a second idler sleeve bearing 110 and a second bearing pin 112, is mounted on the second lug 100 in a hole 109. A torsion spring 114, mounted over the pivot pin 94 functions to bias the second lug 100 relative to the first lug 98 in a manner that will be described in greater detail below. The assembled second embodiment of the agitator drive interrupt mechanism 12 is illustrated in FIG. 4*b*.

Figure 5A:
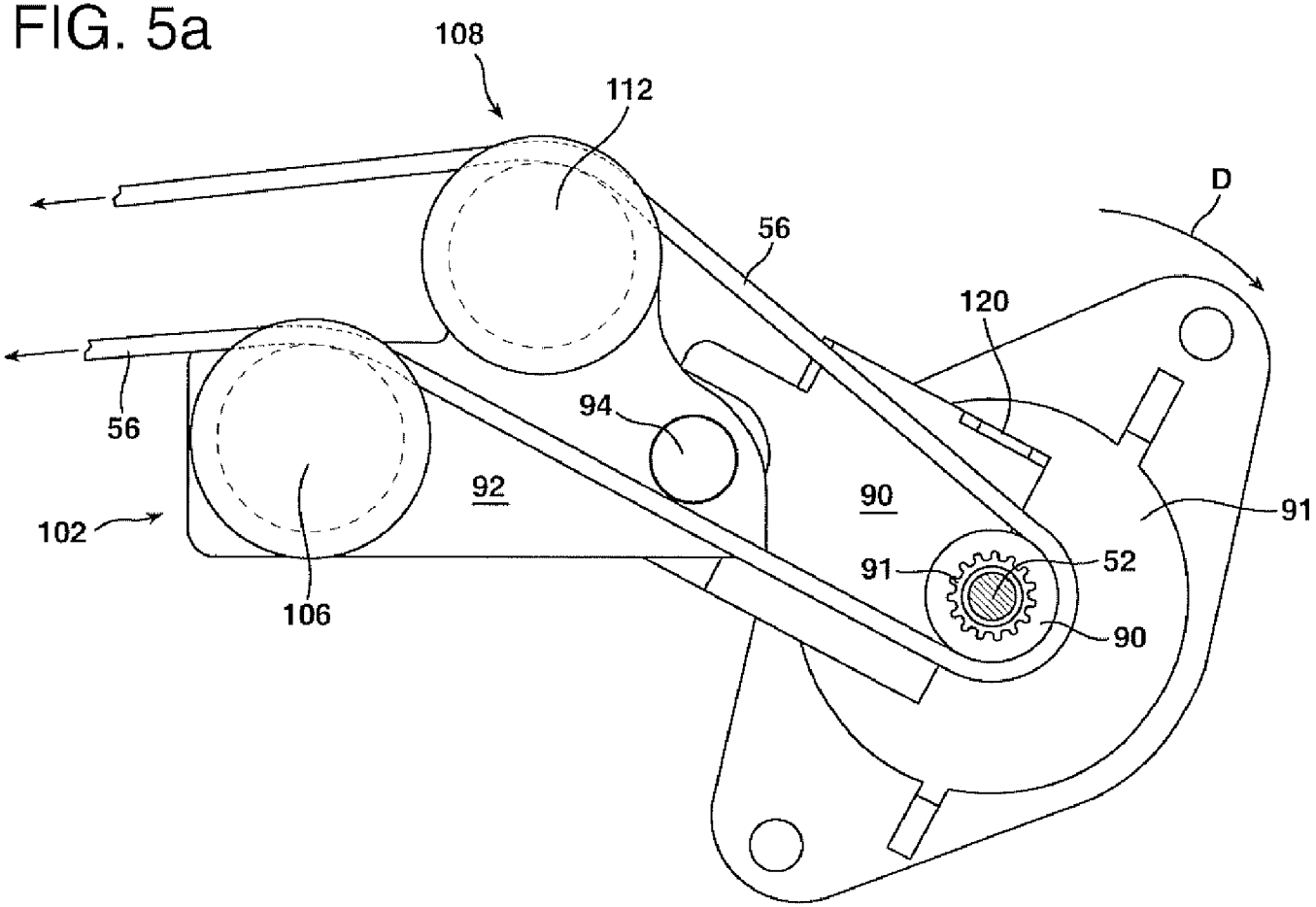
FIGS. 5*a* and 5*b* are respective side elevational views illustrating the second embodiment of the agitator drive interrupt mechanism illustrated in FIGS. 4*a* and 4*b* in the first position wherein drive is provided to the rotary agitator and the second position wherein drive to the rotary agitator is interrupted.
Figure 5B:
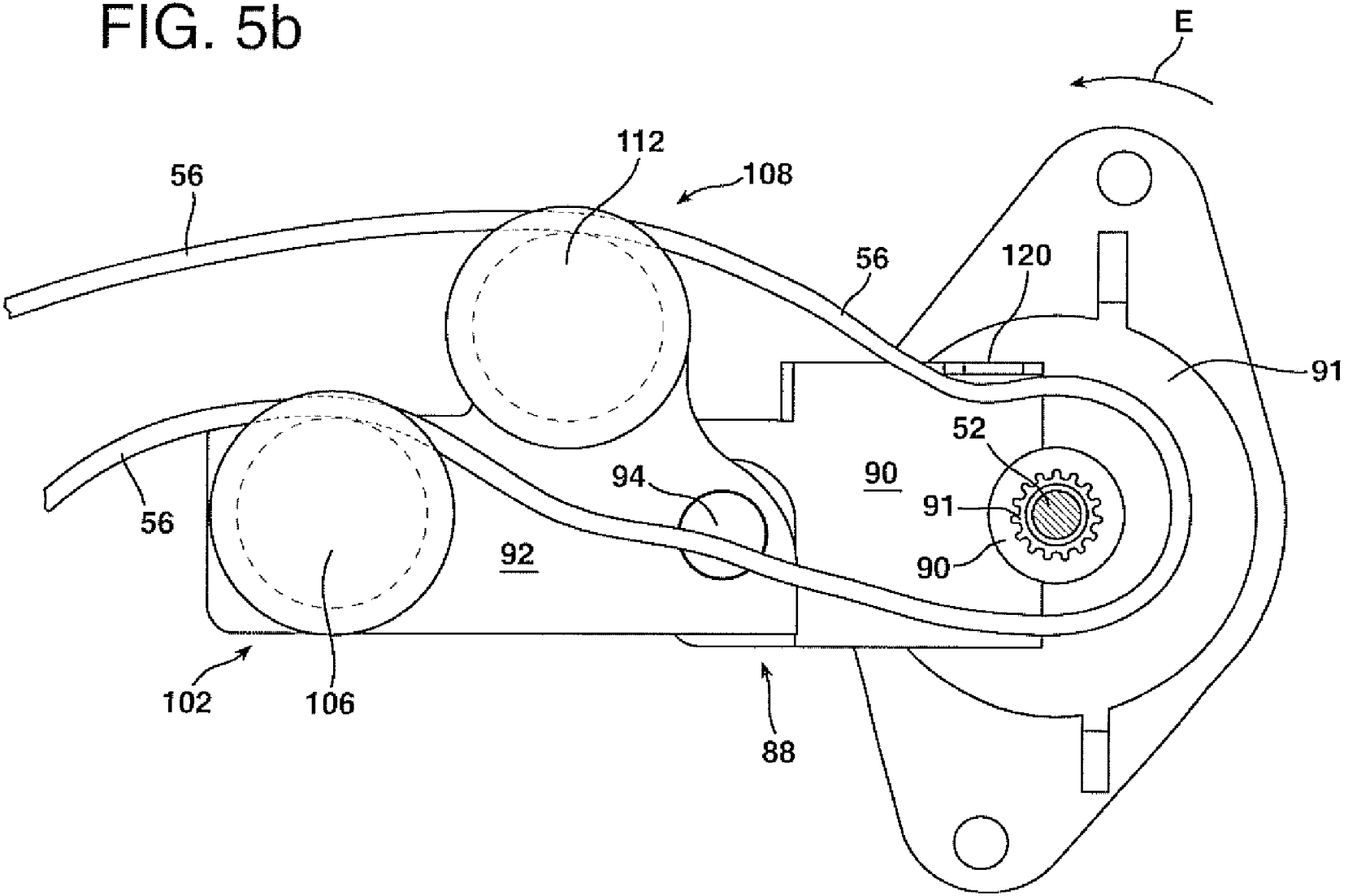

As best illustrated in FIG. 5*b*, when the control assembly 16 is pivoted downwardly into the operative position, the motor housing 91 picots accordingly (note action arrow D). The first section 90 of the idler pulley support 88 is also pivoted in the same direction as the motor housing 91. This loads the torsion spring 114 that then biases the second section 92 of the support 88 so as to pivot the first idler pulley 102 to intercept and extend through the first path of the belt 56 while the second idler pulley 108 intercepts and extends through the second path of the belt 56 (note stop 122 that engages edge 124 of the second section 92 to limit biasing angle of the second section relative to the first section 90 (see also FIG. 4*b*)). More specifically, the torsion spring 114 biases the second section 92 in the direction of action arrow D so as to provide the proper tensioning force on the belt 56 to drive the agitator 46. As a result of the two point contact action of the idler pulleys 102, 108, the belt is quickly tensioned between the drive shaft 52 and the agitator pulley 54 of the agitator 46 to provide drive to the agitator while minimizing wear to the belt.

In contrast, when the control assembly 16 is pivoted in the direction of action arrow E (note FIG. 5*a*) into the storage position as illustrated in FIG. 1, the first section 90 of the idler pulley support 88 is pivoted downwardly by splined/keyed connection to 91 into a substantially horizontal position. This releases the load on the torsion spring 114 so that the second section 92 of the idler pulley support 88 is also pivoted by the return spring force into a horizontal position aligned with the first section 90. As a consequence, the belt 56 is de-tensioned thereby interrupting drive between the drive shaft 52 and the agitator pulley 54 so that rotation of the agitator 46 stops. The belt slack flange 120 engages the belt 56 and functions to hold or localize the belt slack around the drive shaft 52. By interrupting rotation of the agitator 46 when the control assembly 16 is positioned in the storage position, it is possible to prevent undue carpet wear as the vacuum cleaner sits in this position.

In summary, numerous benefits result for employing the concepts of the present invention. The dual idler pulleys and resulting two-point belt contact system provide for more efficient and effective tensioning and detensioning of the drive belt so as to minimize belt wear. The dual idler pulleys and system also maintain the spacing between the belt paths while providing adequate tension and maintaining optimal belt-wrap around the motor shaft.

The foregoing description of the preferred embodiments of the present invention have been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. A floor care appliance, comprising:

a body including a control assembly pivotally connected to a nozzle assembly;

a rotary agitator carried on said nozzle assembly;

a dirt collection vessel carried on said body;

a suction generator carried on said body, said suction generator including a fan and a drive motor with a drive shaft connected to said drive motor;

a belt operatively connecting said drive motor to said rotary agitator; and an agitator drive interrupt mechanism including a pivoting idler pulley support, a first idler pulley carried on said idler pulley support and a second idler pulley carried on said idler pulley support, and a torsion spring received concentrically around said drive shaft, said idler pulley support being displaceable by pivoting movement of said control assembly between a first position wherein said first and second idler pulleys tension said belt to provide drive to said rotary agitator and a second position wherein said first and second idler pulleys de-tension said belt and interrupt drive to said rotary agitator and wherein said torsion spring is configured for biasing said idler pulley support into said second position when said control assembly is in a storage position.

2. The appliance of claim 1, further including an agitator pulley connected to said rotary agitator, said belt extending in a first path and a second path between said drive shaft and said agitator pulley, and said first idler pulley contacting said belt along said first path and said second idler pulley contacting said belt along said second path.

3. The appliance of claim 1, wherein said idler pulley support further includes a belt slack flange wherein said flange holds belt slack adjacent said drive shaft when said idler pulley support is in said second position.

4. The appliance of claim 3, wherein said idler pulley support includes a first lug and a second lug, said first idler pulley being carried on said first lug and said second idler pulley being carried on said second lug.

5. The appliance of claim 4, wherein said first idler pulley includes a first idler sleeve bearing and a first bearing pin carried on said idler pulley support and said second idler pulley includes a second idler sleeve bearing and a second bearing pin carried on said idler pulley support.

6. A floor care appliance, comprising:

a body including a control assembly and a nozzle assembly;

a rotary agitator carried on said nozzle assembly;

a dirt collection vessel carried on said body;

a suction generator carried on said body, said suction generator including a fan and a drive motor with a drive shaft connected to said drive motor;

a belt operatively connecting said drive motor to said rotary agitator; and an agitator drive interrupt mechanism including an idler pulley support, a first idler pulley carried on said idler pulley support, a second idler pulley carried on said idler pulley support, and a torsion spring received concentrically around said drive shaft, said idler pulley support being displaceable between a first position wherein said first and second idler pulleys tension said belt to provide drive to said rotary agitator and a second position wherein said first and second idler pulleys de-tension said belt and interrupt drive to said rotary agitator and wherein said torsion spring is configured for biasing said idler pulley support into said second position when said control assembly is in a storage position.

* * * * *